US007724077B2

(12) United States Patent
Bien

(10) Patent No.: US 7,724,077 B2
(45) Date of Patent: May 25, 2010

(54) STACKED CASCODE CURRENT SOURCE

(75) Inventor: David E. Bien, Glendale, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 12/180,947

(22) Filed: Jul. 28, 2008

(65) Prior Publication Data

US 2010/0019806 A1 Jan. 28, 2010

(51) Int. Cl.
*G05G 1/10* (2006.01)

(52) U.S. Cl. ..... 327/543; 327/540; 327/541

(58) Field of Classification Search ..... 327/543, 327/538, 540, 541, 315
See application file for complete search history.

(56) References Cited

U.S. PATENT DOCUMENTS 4,550,284 A * 10/1985 Sooch ..... 323/315
4,800,339 A * 1/1989 Tanimoto et al. ..... 330/253
6,903,539 B1 6/2005 Hoon et al.
2007/0290740 A1 * 12/2007 Jongsma ..... 327/543

* cited by examiner

*Primary Examiner*—Lincoln Donovan
*Assistant Examiner*—Khareem E Almo
(74) *Attorney, Agent, or Firm*—Ingrassia, Fisher & Lorenz, P.C.

(57) ABSTRACT

Apparatus are provided for a stacked cascode current source. An apparatus is provided for an electrical device comprising an input node and an output node. A first transistor stack is coupled to the input node. The first transistor stack includes a first transistor and a second transistor. A drain terminal and a gate terminal of the first transistor are coupled to the input node. A drain terminal of the second transistor is coupled to a source terminal of the first transistor and a gate terminal of the second transistor is coupled to the input node. A second transistor stack coupled to the first transistor stack and the output node to create a current mirror for the first transistor stack.

19 Claims, 4 Drawing Sheets

STACKED CASCODE CURRENT SOURCE

TECHNICAL FIELD

Embodiments of the subject matter described herein relate generally to current source circuits, and more particularly, embodiments of the subject matter relate to transistor current sources with high output impedance at low operating voltages.

BACKGROUND

It is well known that many circuits rely on signal currents appearing at high impedance nodes in current sources. An ideal current source provides constant current irrespective of voltage across it, although in practice, such an ideal current source is approximated. The output impedance of such current sources may limit circuit performance parameters such as circuit gain, linearity, stability, etc. Often, transistors such as MOSFETs are used to provide high output impedance at a node in a circuit. Ideally, the MOSFET current should vary only slightly with the applied drain-to-source voltage. However, as transistors are made smaller and operating voltages are reduced, the sensitivity of the MOSFET current to the drain voltage increases.

To counteract the resulting decrease in output resistance, circuits are made more complex, either by requiring more devices, or by feedback circuitry. A cascode current source exhibits high output impedance by stacking the output devices in series. While such circuits are suitable for many low voltage applications, the high output impedance is accompanied by a reduction in the operating voltage range. For example, the voltage across the output transistors (e.g., the output voltage) may swing to a low voltage potential, thereby reducing the drain-to-source voltage of the transistors. This causes the transistors to leave the saturation region and significantly reduces the output impedance, which becomes dependent on the output voltage. Thus, the output voltage range capable of sustaining a high output impedance at the output is limited. Furthermore, the operating voltage on the input side must exceed the sum of the threshold voltages for the transistors in order to allow current to flow. Thus, in order to accommodate lower operating voltages, transistors would need to be removed from the circuit, thereby reducing the output impedance.

Another known approach utilizes level shifters in a feedback loop to extend the operating voltage range of the cascode current source. While this technique does improve operating voltage range, it may not be suitable in certain applications. For example, this technique may result in a low drain-to-source voltage at the lower of the two stacked output transistors. Thus, while the output impedance of the circuit is enhanced by the upper transistor, the overall output impedance may be significantly reduced compared to a traditional cascode structure. Furthermore, additional devices such as level shifters, amplifiers, and the like contribute to undesirable effects such as noise, longer settling time, increased power consumption, and inaccuracies associated with component matching.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
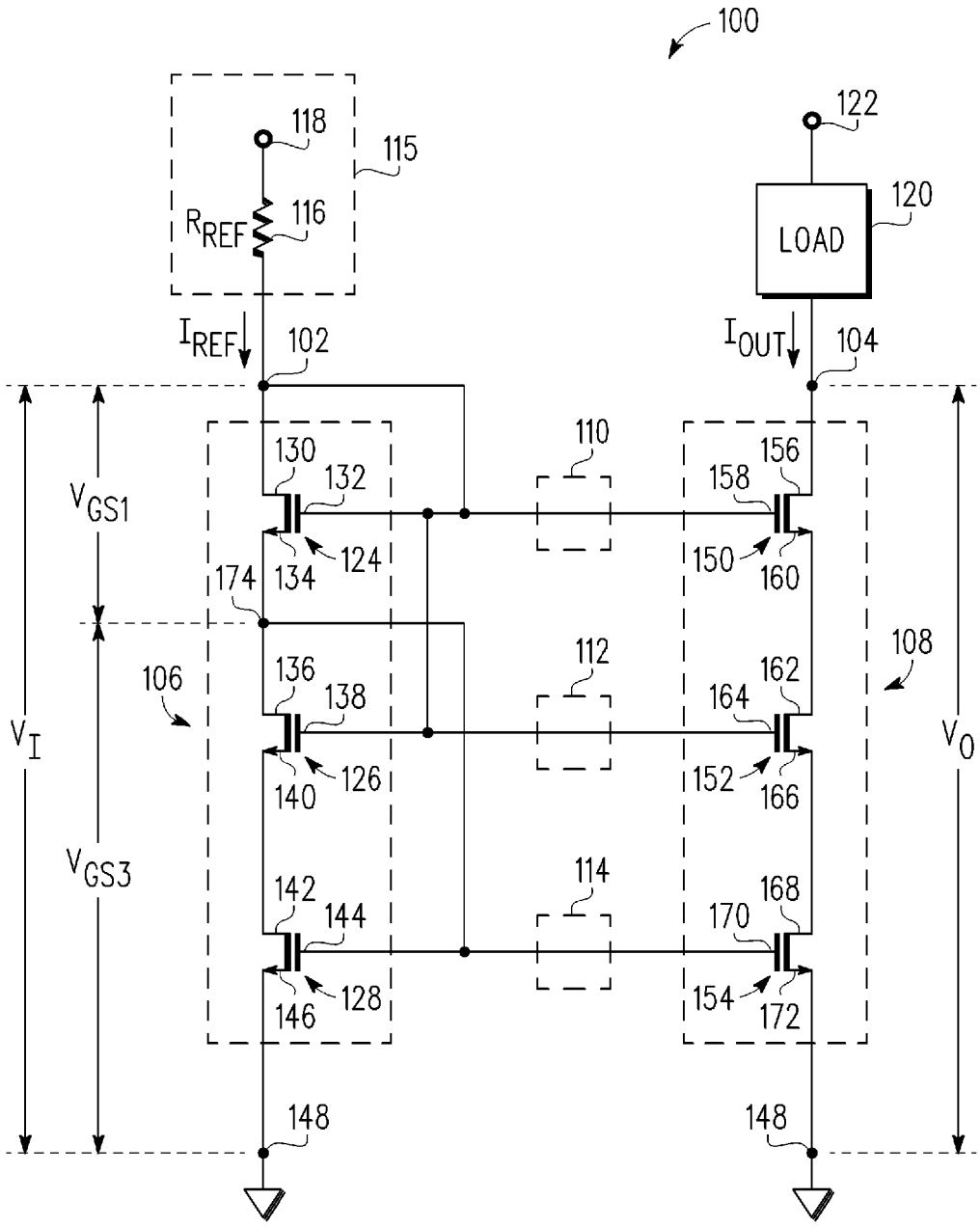
FIG. 1 is a schematic view of a stacked cascode current source circuit in accordance with one embodiment.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The following description refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although the schematic shown in the figures depict one exemplary arrangement of elements, additional intervening elements, devices, features, or components may be present in an embodiment of the depicted subject matter.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

For the sake of brevity, conventional techniques related to biasing, analog circuit design, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter. It should be understood that circuitry described herein may be implemented either in silicon or another semiconductor material or alternatively by software code representation thereof. In addition, certain terminology may also be used in the following description for the purpose of reference only, and thus are not intended to be limiting, and the terms "first", "second" and other such numerical terms referring to structures do not imply a sequence or order unless clearly indicated by the context.

Technologies and concepts discussed herein relate to a stacked cascode current source with high output impedance. The transistors in the stacked cascode current source are configured such that the stacked cascode current source can accommodate reduced operating voltages without removing output devices, and thereby maintaining high output impedance and improved operating voltage range at the output.

Referring now to FIG. 1, a stacked cascode current source 100 may include, without limitation, an input node 102, an output node 104, a first transistor stack 106, and a second transistor stack 108. The second transistor stack 108 may be coupled to the first transistor stack 106 to create common gate nodes 110, 112, 114 between transistor pairs, as described in greater detail below. In such a configuration, the transistor stacks 106, 108 effectively create a current mirror such that the current through the second transistor stack 108, $i_{OUT}$, is substantially equal to a fixed ratio of the current through the first transistor stack 106, $i_{REF}$. In this regard, the first transistor stack 106 may alternatively be referred to as the input transistor stack and the second transistor stack 108 referred to as the output transistor stack. If the devices of first transistor stack 106 and second transistor stack 108 are substantially equal, then $i_{OUT}$ is substantially equal to $i_{REF}$ over an output voltage range ($V_O$), as described in greater detail below. In alternative embodiments, $i_{OUT}$ may be a fixed ratio of $i_{REF}$ (e.g., current scaling) by modifying devices of the transistor stacks 106, 108 (e.g., by modifying the ratio of device widths between the transistor stacks 106, 108), as will be appreciated in the art.

It should be understood that FIG. 1 is a simplified representation of a stacked cascode current source 100 for purposes of explanation and ease of description, and that practical embodiments may include numerous other devices and components to provide additional functions and features, and/or the stacked cascode current source 100 may be part of a much larger electrical circuit, as will be understood. Although FIG. 1 depicts an implementation using n-type MOSFETs (e.g., NMOS), numerous equivalent circuits may be implemented using p-type MOSFETs (e.g., PMOS) or other comparable elements, and FIG. 1 is not intended to limit the application or scope of the subject matter in any way. Further, it should also be noted that although FIG. 1 depicts MOS transistors as three-terminal devices for clarity and ease of explanation, in practice, the devices may include a fourth terminal representing the bulk node of the device, which may be connected to alternate nodes in the circuit as may be desirable, while still maintaining the function and utility of the current source 100. For example, bulk terminals may be connected to the substrate of an integrated circuit, a source terminal of the respective device, or to some other node supplying a suitable voltage, as will be appreciated in the art.

In an exemplary embodiment, the input node 102 is configured to receive an input or reference current, $i_{REF}$ from a current source 115. In accordance with one embodiment, the current source is realized by coupling a reference or sense resistor 116 (RF) in series between a supply node 118 and the input node 102 to establish the reference current, as will be understood. In accordance with one embodiment, the supply node 118 is coupled to and/or configured to receive the supply voltage for the stacked cascode current source 100 or a larger electrical circuit or system which includes the stacked cascode current source 100. It will be appreciated in the art that the voltage at the supply node 118 will vary by application, and the devices comprising transistor stacks 106, 108 should be chosen to be compatible with voltage requirements for a given application. For example, in some low-voltage applications, the voltage at the supply node 118 generally ranges between 1.2V to 1.5V.

In an exemplary embodiment, the output node 104 is configured to source an output current, $i_{OUT}$, for a load 120. In an exemplary embodiment, the output current, $i_{OUT}$, is substantially equal to the reference current, $i_{REF}$. The load 120 may be realized as one or more passive electrical components, active electrical components, and various combinations thereof. In this regard, the load 120 may comprise another electrical circuit utilizing the stacked cascode current source 100 to provide a substantially constant current at a high impedance node in the circuit or system (e.g., node 104), as will be appreciated in the art. For example, the stacked cascode current source 100 may be implemented as part of a current-source digital-to-analog converter (DAC), wherein output node 104 may be coupled to a summing node (or summing junction) in a sigma-delta feedback loop for an analog-to-digital converter (ADC). Accordingly, the characteristics of the load 120 may vary over time, which causes the voltage at the output node 104 ($V_O$) to fluctuate as the stacked cascode current source 100 attempts to maintain a substantially constant output current, $i_{OUT}$. For example, in a NMOS application, the output voltage ($V_O$) may generally vary between the reference voltage (e.g., 0V or ground) and the supply voltage for the circuit, and in some situations, the output voltage may exceed these limits. In accordance with one embodiment, the load 120 may be coupled in series between a second supply node 122 and the output node 104. In an exemplary embodiment, the second supply node 122 is coupled to and/or configured to receive the supply voltage for the stacked cascode current source 100 or another electrical circuit or system. In accordance with one embodiment, the supply nodes 118, 122 may have the same voltage potential.

Still referring to FIG. 1, the first transistor stack 106 is realized as a plurality of stacked transistors 124, 126, 128. As used herein, "stacking transistors," "stacked transistors," "transistor stack," or equivalents thereof, should be understood to describe the configuration where the source terminal of one transistor device is coupled to the drain terminal of another transistor device, such that the current passes through the transistor devices (e.g., between drain and source) in series. In an exemplary embodiment, the second transistor stack 108 is realized as a plurality of stacked transistors 150, 152, 154 of the same type and having the same number of transistors as the first transistor stack 106. Although FIG. 1 depicts transistor stacks having three transistors, in practice, additional or fewer transistors may be used, depending on the needs of the specific application, and FIG. 1 is not intended to limit the scope of the subject matter in any way.

Referring now to the first transistor stack 106, in an exemplary embodiment, a drain terminal 130 and a gate terminal 132 of a first transistor 124 are coupled to the input node 102. The source terminal 134 is coupled to the drain terminal 136 of a second transistor 126 at a first node 174. The gate terminal 138 of the second transistor 126 is also coupled to the input node 102. The source terminal 140 is coupled to a drain terminal 142 of a third transistor 128. The gate terminal 144 of the third transistor 128 is coupled to the first node 174. Alternatively, the gate terminal 144 may be referred to as being coupled to source terminal 134 of the first transistor 124 or the drain terminal 136 of the second transistor 126. The source terminal 146 of the third transistor 128 may be coupled to a reference node 148. In an exemplary embodiment, when n-type transistors are used, the reference node 148 corresponds to an electrical ground or is otherwise configured to receive or establish a reference potential.

Referring now to the second transistor stack 108, in an exemplary embodiment, the drain terminal 156 of a fourth transistor 150 is coupled to the output node 104. The gate terminal 158 of the fourth transistor 150 is coupled to the gate terminal 132 of the first transistor 124 (e.g., input node 102) to establish a common gate node 110, such that the transistors 124, 150 may be understood as forming a first transistor pair. The source terminal 160 of the fourth transistor 150 is coupled to the drain terminal 162 of a fifth transistor 152. The gate terminal 164 of the fifth transistor 152 is coupled to the gate terminal 138 of the second transistor 126 (e.g., input node 102) to establish a common gate node 112 (e.g., the transistors 126, 152 form a second transistor pair). The source terminal 166 is coupled to the drain terminal 168 of a sixth transistor 154. The gate terminal 170 of the sixth transistor 154 is coupled to the gate terminal 144 of the third transistor 128 to establish a common gate node 114 (e.g., the transistors 128, 154 form a third transistor pair). In an exemplary embodiment, when n-type transistors are used, the source terminal 172 of the sixth transistor 154 is coupled to the reference node 148 or otherwise configured to receive or establish a reference potential (e.g., the source terminal 172 may be coupled to the source terminal 146 of the third transistor 128). Although not shown, in practice the transistors 124, 126, 128, 150, 152, 154 may each include a fourth terminal (alternatively referred to as body, base, bulk, or substrate), which may each be coupled to the source of the respective transistor 124, 126, 128, 150, 152, 154, or some other suitable voltage potential, as will be appreciated in the art.

For certain embodiments of stacked cascode current source 100, the terminals of the various transistors are connected together as depicted in FIG. 1. Notably, the common gate node 110, which also corresponds to the common gate node 112, represents a common node for input node 102, the drain terminal 130 and gate terminal 132 of first transistor 124, the gate terminal 138 of second transistor 126, the gate terminal 158 of fourth transistor 150, and the gate terminal 164 of fifth transistor 152. The common gate node 114 represents a common node for the source terminal 134 of first transistor 124, node 174, the drain terminal 136 of second transistor 126, the gate terminal 144 of third transistor 128, and the gate terminal 170 of sixth transistor 154.

Figure 2:
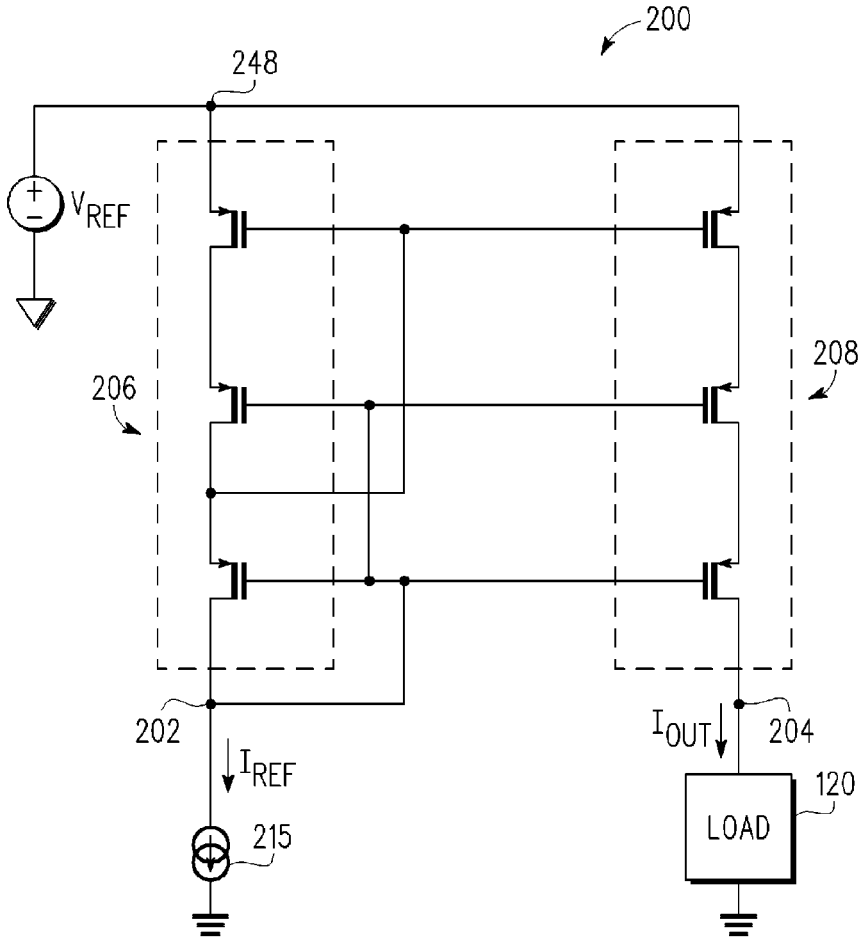
FIG. 2 is a schematic view of a stacked cascode current source circuit showing a PMOS transistor implementation in accordance with one embodiment.

Referring now to FIG. 2, in accordance with one embodiment, a stacked cascode current source 200 may be implemented using p-type transistors. A first transistor stack 206 may be coupled between an input node 202 and a reference node 248, and a second transistor stack 208 may be coupled between an output node 204 and the reference node 248. The reference node 248 may be coupled to a positive voltage, $V_{REF}$, and/or the current source 215 and load 120 may be coupled to an electrical ground or a negative voltage potential to properly bias the transistor stacks 206, 208, as will be understood in the art. Other than the biasing aspects, the first transistor stack 206 and second transistor stack 208 are configured in essentially the same manner as described above in the context of FIG. 1, and such description will not be redundantly described in the context of FIG. 2. Furthermore, although the following description is primarily in the context of the n-type implementation depicted in FIG. 1, it will be appreciated in the art that the n-type stacked cascode current source 100 is substantially equivalent to the p-type stacked cascode current source 200.

Referring again to FIG. 1, by virtue of its configuration, the first transistor stack 106 may be operated normally (e.g., transistors 124, 126, 128 all turned on and conducting in normal forward mode) at a lower operating voltage, $V_I$ (e.g., voltage potential at input node 102 relative to the reference node 148), than a conventional cascode current source having the same number of transistors. For example, assuming a stacked cascode current source 100 with transistors with substantially equal threshold voltages, in order to operate the first transistor stack 106 in the above-threshold region, the operating voltage at the input node 102, $V_I$, must be greater than or equal to the sum of the gate-to-source voltage of the first transistor, $V_I s_1$ (because its drain terminal 130 and gate terminal 132 are coupled at the input node 102), and the voltage at node 174, which is equal to the gate-to-source voltage of the third transistor, $V_{gs_3}$. For normal forward operation, the minimum operating gate-to-source voltage of the first transistor 124 is the threshold voltage of the first transistor 124 (e.g., $V_{gs_1}=V_T$). The minimum operating voltage at node 174 must be greater than or equal to the threshold voltage of the third transistor 128 because its gate terminal 144 is coupled to node 174). Thus, assuming relatively equal threshold voltages, the minimum operating voltage at the input node 102 may be approximated as $V_I \geqq 2V_T$. The second transistor 126 may operate closer to or in its linear region (or ohmic mode) where its drain-to-source voltage, $V_{ds_2}$, is directly proportional to the drain current (e.g., $i_{REF}$), and $V_{ds_2} << V_{TH}$ for relatively low reference currents (e.g., $V_I \approx 2V_T$).

By comparison, for above-threshold operation of a three transistor cascode current source (where the gate and drain terminals of each the respective transistors on the input side are coupled), the minimum voltage at the input node must be greater than or equal to the sum of gate-to-source voltages, i.e., the transistor threshold voltages (e.g., $V_{I_cascode} \geqq 3V_T$), in order to operate the transistors. Accordingly, the minimum operating voltage for the stacked cascode current source 100 may be significantly less than the three transistor cascode current source and comparable to a two transistor cascode current source. For example, assuming equivalent transistor threshold voltages of approximately 0.4 V to 0.5 V and identical reference currents of 2 μA, the required voltage at the input node 102 of the stacked cascode current source 100 is approximately 0.94 mV compared to approximately 1.37V for the three transistor conventional cascode current source, a difference of approximately 430 mV. This difference is approximately the threshold voltage for one transistor (e.g., second transistor 126 which is not connected gate to drain).

Figure 3:
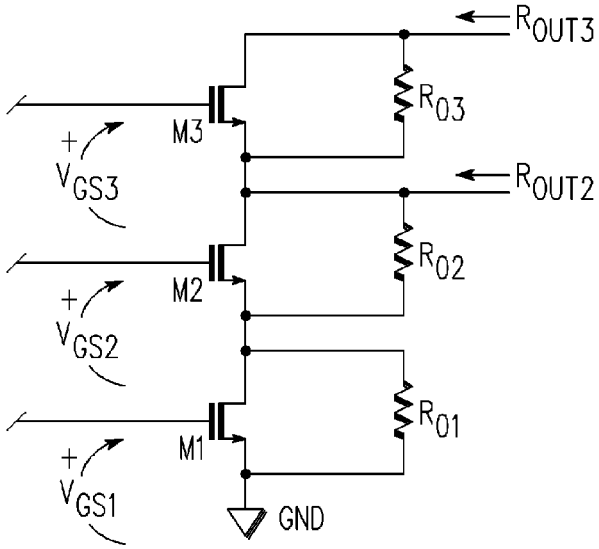
FIG. 3 is a schematic view showing an exemplary small signal model for approximating output impedance of an output transistor stack suitable for use in the stacked cascode current source of FIG. 1.
Figure 4:
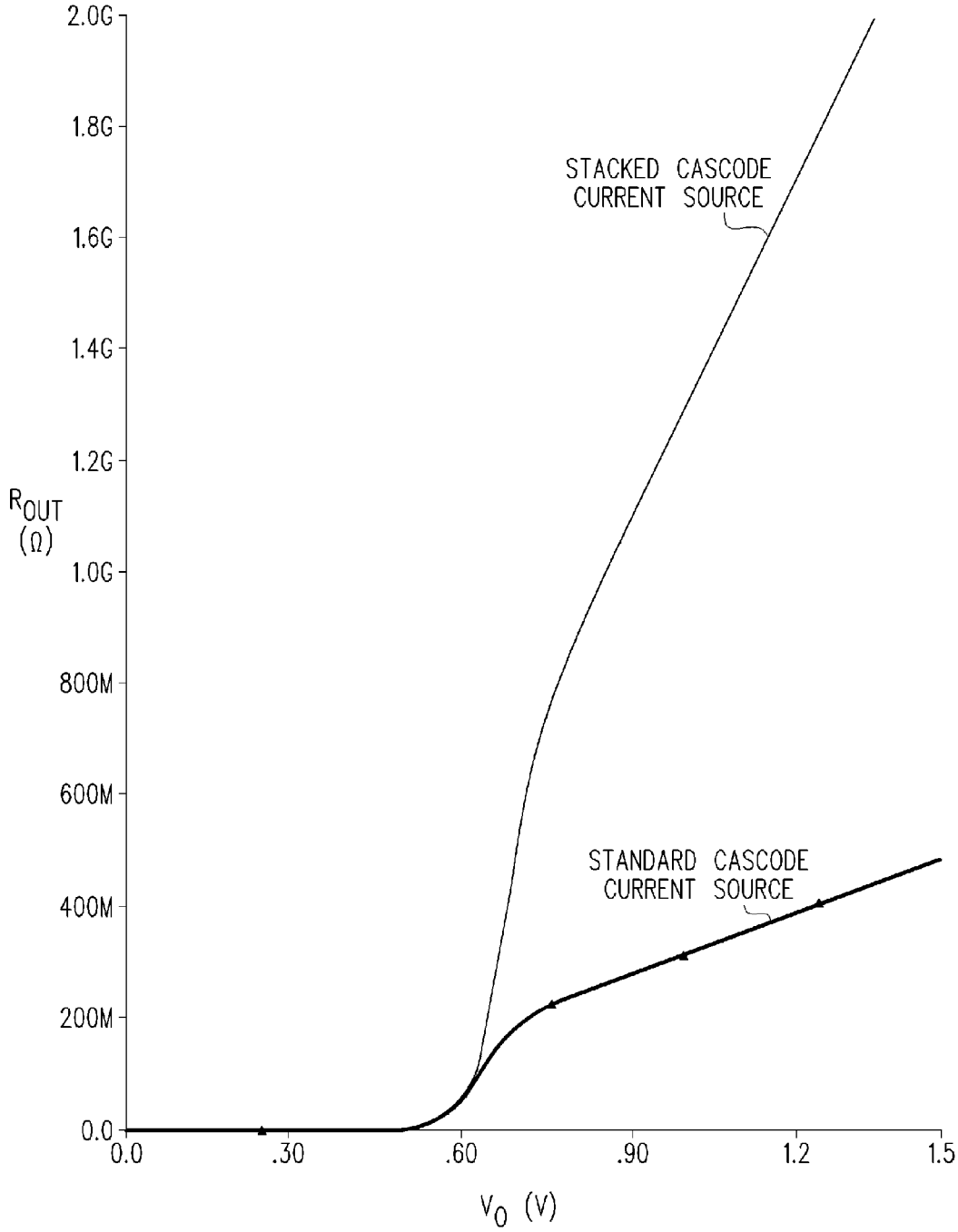
FIG. 4 is a graph of output impedance versus voltage at the output node for comparing a stacked cascode current source and a standard cascode current source in an exemplary embodiment.

Referring now to FIG. 3 and FIG. 4, although the stacked cascode current source 100 and a two level cascode current source have relatively similar input operating voltage (e.g., $V_I \approx 2V_T$), the stacked cascode current source 100 exhibits a higher output impedance across a similar or wider range of output voltages ($V_O$) due to the additional transistor in the output stack (e.g., transistor stack 108). For example, using small signal modeling techniques, the output impedance of a two transistor stack (e.g., two transistor cascode current source) may be approximated as $$R_{out2} = r_{o1} \cdot \left(1 + \frac{r_{o2}}{r_{o1}} + g_{m2} \cdot r_{o2}\right)$$

as compared to the output impedance approximation of a three transistor stack (e.g., transistor stack 108 of the stacked cascode current source 100), $$R_{out3} = R_{out2}\left[1 + \frac{r_{o3}}{1 + \frac{r_{o2}}{r_{o1}} + g_{m2} \cdot r_{o2} \cdot r_{o1}} + g_{m3} \cdot r_{o3}\right],$$

where $g_m$ is the transconductance and $r_o$ is the output resistance for the respective transistors. Accordingly, the output impedance of the stacked cascode current source 100 is approximately two to five times greater than the output impedance of the two transistor cascode current source over the relevant operating voltage range. FIG. 4 shows the output impedance ($R_{out}$) versus output voltage ($V_O$) for the stacked cascode current source 100 and a two level cascode current source, assuming substantially equivalent transistor threshold voltages, reference currents ($i_{REF}$) and input voltages ($V_I$). As shown, the stacked cascode current source 100 maintains higher output impedance over a wider output voltage range. Although not illustrated, the stacked cascode current source 100 may also be operated in the sub-threshold region (e.g., at sub-threshold reference current levels) and achieve a higher output impedance across a wider output voltage range when compared to an equivalent cascode current source, and the subject matter described herein is not intended to be limited to any particular mode of operation.

Figure 5:
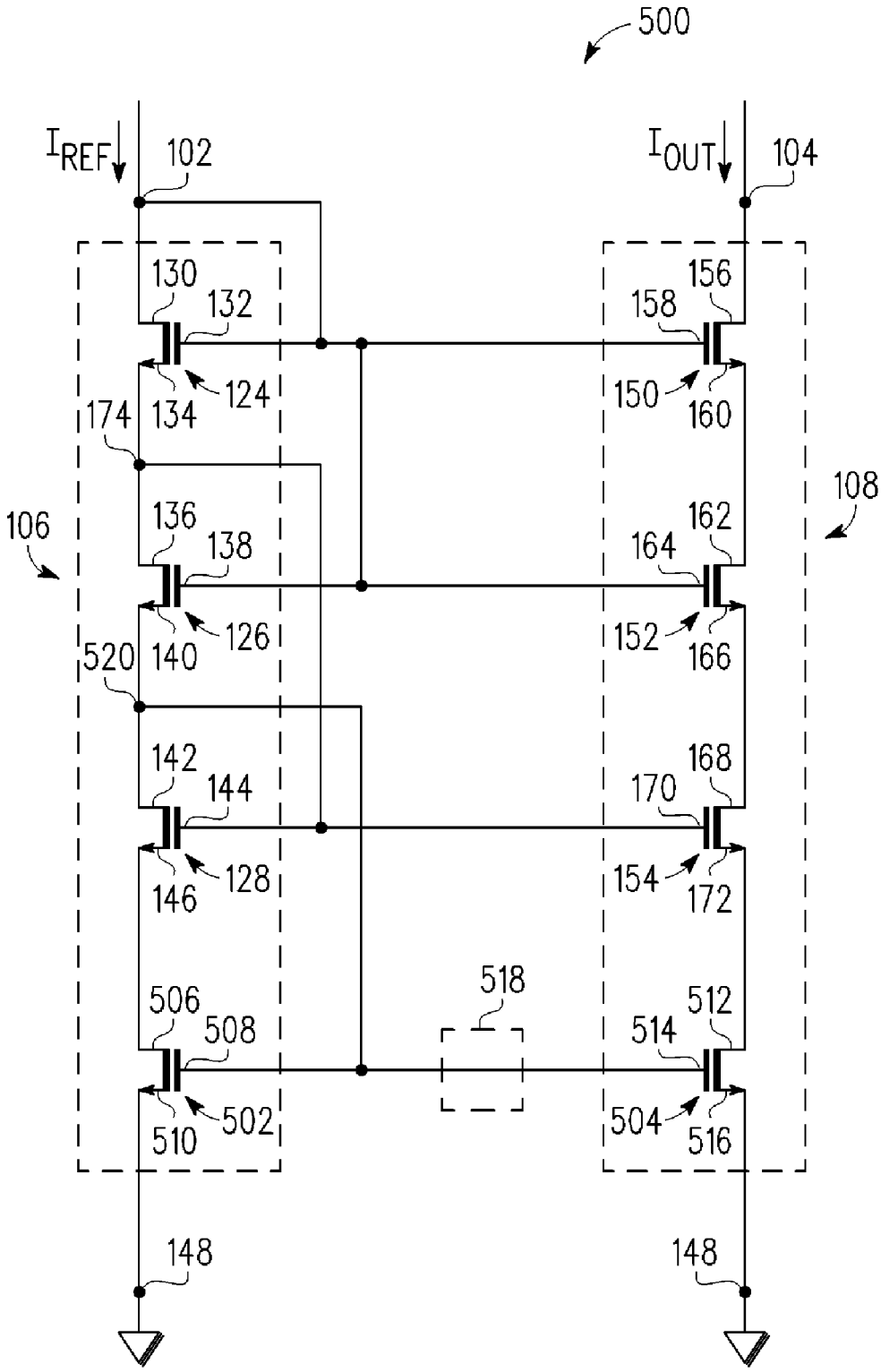
FIG. 5 is a schematic view of a modified stacked cascode current source in accordance with one embodiment.

Referring now to FIG. 5, in accordance with one embodiment, a stacked cascode current source 500 may include additional transistor pairs to achieve higher output impedance, as desired. It should be understood that FIG. 5 depicts merely one possible modification of the stacked cascode current source 500, and an exhaustive list of potential modifications will not be redundantly described herein. As shown, a seventh transistor 502 may be added to the first transistor stack 106 and an eighth transistor 504 may be added to the second transistor stack 108. In an exemplary embodiment, the drain terminal 506 of the seventh transistor is coupled to the source terminal 146 of the third transistor 128 and the drain terminal 512 of the eighth transistor 504 is coupled to the source terminal 172 of the sixth transistor 154. The gate terminal 508 of the seventh transistor 502 is coupled to the gate terminal 514 of the eighth transistor 504 to establish a common gate node 518. The source terminal 510 of the seventh transistor 502 may be coupled to the reference node 148 or otherwise configured to receive or establish a reference potential. Similarly, the source terminal 516 of the eighth transistor 504 may be coupled to the reference node 148 or otherwise configured to receive or establish a reference potential (e.g., the source terminal 516 may be coupled to the source terminal 510 of the seventh transistor 502). Depending on the embodiment, the gate terminal 508 of the seventh transistor 502 (or alternatively gate node 518) may be coupled to various locations within the first transistor stack 106. In an exemplary embodiment, the gate terminal 508 is coupled to a node 520 coupled between the source terminal 140 of the second transistor 126 and the drain terminal 142 of the third transistor 128 (or alternatively, node 520 is coupled to source terminal 140 or coupled to drain terminal 142). In an alternative embodiment, the gate terminal 508 may be coupled to node 174 between the first transistor 124 and the second transistor 126.

One advantage of the stacked cascode current source topology described above is that the stacked cascode current source maintains desirable characteristics (e.g., low output capacitance, low noise, good matching, frequency response) of a normal cascode current source with increased output impedance and improved output voltage range for lower operating voltages. Furthermore, the benefits may be achieved without the added complexity of using feedback circuitry, amplifiers, buffers, or level shifters.

In summary, systems, devices, and methods configured in accordance with example embodiments of the invention relate to:

An apparatus is provided for a stacked cascode current source. The stacked cascode current source comprises an input node and an output node. A first transistor has a first drain terminal coupled to the input node, a first gate terminal coupled to the input node, and a first source terminal. A second transistor has a second drain terminal coupled to the first source terminal, a second gate terminal coupled to the input node, and a second source terminal. A third transistor has a third drain terminal coupled to the second source terminal, and a third gate terminal coupled to the first source terminal. A fourth transistor has a fourth drain terminal coupled to the output node, a fourth gate terminal coupled to the first gate terminal, and a fourth source terminal. A fifth transistor has a fifth drain terminal coupled to the fourth source terminal, a fifth gate terminal coupled to the second gate terminal, and a fifth source terminal. A sixth transistor having a sixth drain terminal coupled to the fifth source terminal, and a sixth gate terminal coupled to the third gate terminal.

In accordance with one embodiment, the third transistor has a third source terminal, wherein the stacked cascode current source further comprises a seventh transistor having a seventh drain terminal coupled to the third source terminal, and a seventh gate terminal coupled to the second source terminal. The sixth transistor may have a sixth source terminal, wherein the stacked cascode current source further comprises an eighth transistor having an eighth drain terminal coupled to the sixth source terminal, and an eighth gate terminal coupled to the seventh gate terminal. The seventh transistor may have a seventh source terminal and the eighth transistor may have an eighth source terminal, wherein the seventh source terminal and the eighth source terminal are coupled to establish a reference voltage potential.

In another embodiment, the third transistor has a third source terminal and the sixth transistor has a sixth source terminal, wherein the third source terminal is coupled to the sixth source terminal to establish a reference voltage potential. In another embodiment, the stacked cascode current source may further comprise a source coupled to the input node and configured to provide a reference current to the input node, wherein current at the output node is substantially equal to the reference current. The source may further comprise a resistor coupled electrically in series between a voltage supply and the input node. A load may be coupled between a voltage supply and the output node, wherein current at the output node is substantially equal to the reference current. In another embodiment, the current at the output node is substantially equal to a fixed ratio of the reference current.

An apparatus is provided for an electrical device. The electrical device comprises an input node and an output node. A first transistor pair has a first transistor, a second transistor, and a first common gate node coupled to the input node. A first terminal of the first transistor is coupled to the input node, and a second terminal of the second transistor is coupled to the output node. A second transistor pair has a second common gate node coupled to the input node, wherein the first transistor pair and the second transistor pair are stacked. A third transistor pair has a third common gate node coupled to a third terminal of the first transistor, wherein the second transistor pair and the third transistor pair are stacked. The third transistor pair may have a common source node configured to establish a reference ground.

In another embodiment, the second transistor pair may have a third transistor having a fourth terminal coupled to the third terminal, wherein the electrical device further comprises a fourth transistor pair having a fourth common gate node coupled to a fifth terminal of the third transistor, wherein the third transistor pair and the fourth transistor pair are stacked. The fourth transistor pair may have a common source node configured to establish a reference ground.

In yet another embodiment, the electrical device may further comprise a current source coupled to the input node, the current source being configured to provide a reference current to the input node. In accordance with one embodiment, current at the output node is substantially equal to a fixed ratio of the reference current.

An apparatus is provided for an electrical device. The electrical device comprises an input node and an output node. A first transistor stack is coupled to the input node. The first transistor stack comprises a first transistor and a second transistor. A drain terminal of the first transistor is coupled to the input node and a gate terminal of the first transistor is coupled to the input node. A drain terminal of the second transistor is coupled to a source terminal of the first transistor and a gate terminal of the second transistor is coupled to the input node. A second transistor stack is coupled to the first transistor stack and the output node to create a current mirror for the first transistor stack. The second transistor stack may comprise a plurality of stacked transistors having gate terminals coupled to gate terminals of the first transistor stack. The second transistor stack may further comprise a third transistor having a drain terminal coupled to the output node. In one embodiment, a source is coupled to the input node, the source being configured to provide a reference current to the input node, wherein current at the output node is substantially equal to the reference current. In another embodiment, the first transistor stack and the second transistor stack have a common source node configured to establish a reference voltage potential.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application

What is claimed is:

1. A stacked cascode current source comprising:

an input node;

an output node;

a first transistor having a first drain terminal coupled to the input node, a first gate terminal coupled to the input node, and a first source terminal;

a second transistor having a second drain terminal coupled to the first source terminal, a second gate terminal coupled to the input node, and a second source terminal;

a third transistor having a third drain terminal coupled to the second source terminal, and a third gate terminal coupled to the first source terminal;

a fourth transistor having a fourth drain terminal coupled to the output node, a fourth gate terminal coupled to the first gate terminal, and a fourth source terminal;

a fifth transistor having a fifth drain terminal coupled to the fourth source terminal, a fifth gate terminal coupled to the second gate terminal, and a fifth source terminal; and a sixth transistor having a sixth drain terminal coupled to the fifth source terminal, and a sixth gate terminal coupled to the third gate terminal.

2. The stacked cascode current source of claim 1, the third transistor having a third source terminal and the sixth transistor having a sixth source terminal, wherein the stacked cascode current source further comprises:

a seventh transistor having a seventh drain terminal coupled to the third source terminal, and a seventh gate terminal coupled to the second source terminal; and an eighth transistor having an eighth drain terminal coupled to the sixth source terminal, and an eighth gate terminal coupled to the seventh gate terminal.

3. The stacked cascode current source of claim 2, the seventh transistor having a seventh source terminal, the eighth transistor having an eighth source terminal, wherein the seventh source terminal and the eighth source terminal are coupled to establish a reference voltage potential.

4. The stacked cascode current source of claim 1, the third transistor having a third source terminal, the sixth transistor having a sixth source terminal, wherein the third source terminal is coupled to the sixth source terminal to establish a reference voltage potential.

5. The stacked cascode current source of claim 1, further comprising a source coupled to the input node, the source being configured to provide a reference current to the input node.

6. The stacked cascode current source of claim 5, wherein current at the output node is substantially equal to the reference current.

7. The stacked cascode current source of claim 6, wherein the current at the output node is substantially equal to a fixed ratio of the reference current.

8. The stacked cascode current source of claim 6, wherein the source comprises a resistor coupled electrically in series between a voltage supply and the input node.

9. The stacked cascode current source of claim 6, further comprising a load coupled between a voltage supply and the output node, wherein current through the load is substantially equal to the reference current.

10. An electrical device comprising:

an input node;

an output node;

a first transistor pair having a first transistor, a second transistor, and a first common gate node coupled to the input node, wherein a drain terminal of the first transistor is coupled to the input node, and a drain terminal of the second transistor is coupled to the output node;

a second transistor pair having a second common gate node coupled to the input node, wherein the first transistor pair and the second transistor pair are stacked, the second transistor pair including a third transistor having a drain terminal coupled to a source terminal of the first transistor and a gate terminal coupled to the second common gate node; and a third transistor pair having a third common gate node coupled to the source terminal of the first transistor, wherein the second transistor pair and the third transistor pair are stacked, the third transistor pair including a fourth transistor having a drain terminal coupled to a source terminal of the third transistor and a gate terminal coupled to the third common gate node.

11. The electrical device of claim 10, wherein the electrical device further comprises a fourth transistor pair having a fourth common gate node coupled to the drain terminal of the third transistor, wherein the third transistor pair and the fourth transistor pair are stacked.

12. The electrical device of claim 11, wherein the fourth transistor pair has a common source node configured to establish a reference ground.

13. The electrical device of claim 10, wherein the third transistor pair has a common source node configured to establish a reference ground.

14. The electrical device of claim 10, further comprising a current source coupled to the input node, the current source being configured to provide a reference current to the input node.

15. The electrical device of claim 14, wherein current at the output node is substantially equal to a fixed ratio of the reference current.

16. An electrical device comprising:

an input node;

an output node;

a first transistor stack coupled to the input node, the first transistor stack comprising a first transistor, a second transistor, and a third transistor, wherein:

a drain terminal of the first transistor is coupled to the input node;

a gate terminal of the first transistor is coupled to the input node;

a drain terminal of the second transistor is coupled to a source terminal of the first transistor;

a gate terminal of the second transistor is coupled to the input node;

a drain terminal of the third transistor is coupled to a source terminal of the second transistor; and a gate terminal of the third transistor is coupled to the source terminal of the first transistor; and a second transistor stack coupled to the first transistor stack and the output node to create a current mirror for the first transistor stack, the second transistor stack comprising a fourth transistor, a fifth transistor, and a sixth transistor, wherein:

a drain terminal of the fourth transistor is coupled to the output node;

a gate terminal of the fourth transistor is coupled to the gate terminal of the first transistor;

a drain terminal of the fifth transistor is coupled to a source terminal of the fourth transistor;

a gate terminal of the fifth transistor is coupled to the gate terminal of the second transistor;

a drain terminal of the sixth transistor is coupled to a source terminal of the fifth transistor; and a gate terminal of the sixth transistor is coupled to the gate terminal of the third transistor.

17. The electrical device of claim 16, wherein the second transistor stack comprises a plurality of stacked transistors having gate terminals coupled to gate terminals of the first transistor stack.

18. The electrical device of claim 16, further comprising a source coupled to the input node, the source being configured to provide a reference current to the input node, wherein current at the output node is substantially equal to the reference current.

19. The electrical device of claim 16, wherein the first transistor stack and the second transistor stack have a common source node configured to establish a reference voltage potential.

* * * * *